US009689144B2

(12) United States Patent
Roden et al.

(10) Patent No.: US 9,689,144 B2
(45) Date of Patent: Jun. 27, 2017

(54) CONFIGURABLE COUNTERWEIGHT DEVICE AND SYSTEM FOR A MATERIAL HANDLING MACHINE

(71) Applicants: Thomas V Roden, Port Washington, WI (US); Edward S Werner, West Bend, WI (US)

(72) Inventors: Thomas V Roden, Port Washington, WI (US); Edward S Werner, West Bend, WI (US)

( * ) Notice: Subject to any disclaimer, the term of this patent is extended or adjusted under 35 U.S.C. 154(b) by 313 days.

(21) Appl. No.: 14/329,536

(22) Filed: Jul. 11, 2014

(65) Prior Publication Data

US 2015/0003948 A1 Jan. 1, 2015

Related U.S. Application Data

(63) Continuation of application No. 13/199,356, filed on Aug. 27, 2011, now Pat. No. 8,807,910.

(51) Int. Cl.

| | |
|---|---|
| ***E02F 9/18*** | (2006.01) |
| ***B66C 23/72*** | (2006.01) |
| ***B66F 9/075*** | (2006.01) |
| ***E02F 3/96*** | (2006.01) |

(52) U.S. Cl.

CPC ..... *E02F 9/18* (2013.01); *B66C 23/72* (2013.01); *B66F 9/07554* (2013.01); *E02F 3/96* (2013.01)

(58) Field of Classification Search

CPC ..... B66C 23/72; B66F 9/07554; E02F 9/18; E02F 3/96; B62D 37/04; B62D 49/085

USPC ..... 414/673, 719; 212/198, 279; 280/758

See application file for complete search history.

(56) References Cited

U.S. PATENT DOCUMENTS

| | | | | |
|---|---|---|---|---|
| 2,820,556 | A * | 1/1958 | Davis | B66C 23/74 414/719 |
| 3,497,095 | A * | 2/1970 | Couberly | B62D 37/04 414/629 |
| 4,299,530 | A * | 11/1981 | Schaeff | B62D 49/085 414/673 |
| 4,861,069 | A * | 8/1989 | Gunter | E02F 9/18 414/719 |
| 6,315,325 | B1 * | 11/2001 | Dunn | B62D 37/04 280/755 |
| 7,497,641 | B1 * | 3/2009 | Frelich | E01C 19/48 172/611 |

* cited by examiner

*Primary Examiner* — Scott Lowe
(74) *Attorney, Agent, or Firm* — Mandy L. Tran; Ceres Patent & Technology, LLC

(57) ABSTRACT

The present invention provides a configurable and variable counterweight system for a material handling machine comprising one or more planar paths, said planar paths containing any one or combinations of straight, curved or angled portions between at least a first and second end, said planar path having transferable counterweights, said planar path or counterweights communicating with a control device and system, said control device and system comprising one or more drive unit and optionally one or more sensors, said counterweights being able to move along any curved, angled or straight portions of said planar path.

15 Claims, 10 Drawing Sheets

CONFIGURABLE COUNTERWEIGHT DEVICE AND SYSTEM FOR A MATERIAL HANDLING MACHINE

CROSS REFERENCE TO RELATED APPLICATIONS

This continuation-in-part utility patent application claims priority benefit of and incorporates by reference the full and complete disclosure of pending patent application Ser. No. 13/199,356, filed Aug. 27, 2011.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND

Field of Invention

The present invention relates to a configurable counterweight device and system attachable to material handling machines.

Background of the Invention

Material handling machines are heavy transport equipment and vehicles that carry and move large loads of material. Total work load is typically leveraged against the size, shape and weight of the handling machines. Material handling machines are commonly designed for the specific type of task and size of load intended to bear. As such, there are a great many varieties of single purpose or narrowly purposed material handling machines. Consider the limited functionalities between a skid steer, fork lift, farm tractor, digger and cantilevered crane. Each machine having design features specific to a type of work renders many uncommonly designed machines. As such, it is difficult to create universal cross over accessories to improve cross over functions for material handling machines given the great disparity in machine design and construction.

Counterweighing devices and systems have in the past been developed to improve safety and leverage capacity. Yet, the manner by which load is used and distributed on a vehicle may further be maximized to give new cross over function. Smaller vehicles may mimic the size and leveraging capacity of larger vehicles depending on the amount and manner of distributing additional load on said smaller vehicle. Flat surface vehicles may take on multi-terrain work if there were a way to improve lower central balance at the proximal sides. Yet, none of the prior art considers the value of counterweighing devices as a cross-over tool.

Existing counterweighing devices are fairly rudimentary in nature and ineffective in design. Most attempt to address interests of safety, operational ease and flexibility in distribution of weights with the element of adjustability. The hydraulic force arm feature is a common theme of design among those relevant inventions. U.S. Pat. No. 5,685,563 provides a counterweight system wherein counterweight blocks are held within a track and moved by a hydraulic force arm, said hydraulic force arm being limited in size and is attached to a motor block. The range in distance of movement is minimal, limited by the force arm attachment to the motor block. The motor being necessarily attached to the force arm renders this design awkward and space consuming. This device is impractical for most material handling machines that lack available space to start. See also Couberly, U.S. Pat. No. 3,497,095; Gunter, U.S. Pat. No. 4,861,069; Jacobson, U.S. Pat. No. 3,630,317; Locke, U.S. Pat. No. 2,916,172.

The ideal location to place counterweights on a machine should be determined by the type of work sought to be achieved. In a machine whose job requires a forward and or downward moving force, such as with a bulldozer, skid loader with jackhammer, drill or any other implement requiring downward force, counterweight may preferably be positioned to the front for additional reinforcement. In the same machine having an upward and rearward moving load, such as a cantilevered lifting arm, counterweight positioned towards the lower rear portion of the machine helps to maintain balance and control. The ideal counterweight device should allow wide range of adjustable movement and variable distribution of weight to match the extreme swings of balance and maximize potential functionalities of a working machine.

To date, existing devices are ineffective in providing maximal benefit to counterweighing systems. There is a need in the industry for a counterweight device and system that maximizes potential benefits to the safety, flexibility, cross-over adaptability of material handling machines. All patents and applications referred herein are incorporated by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

SUMMARY OF THE INVENTION

According to the intention of the invention herein, a single counterweight device and system may be attached around one or more sides of a vehicle along one or more planar paths and in parallel or intersecting direction. Its thin linear (space saving) design enables the device to be attached to the bottom of a material handling vehicle, improving center of gravity control of said vehicle. Alternatively, multiple devices and systems may be strategically positioned in choice configurations, moving together or separately along one or more planar surfaces, at parallel or intersecting direction on a machine to achieve a desired type of counterweighing effect. The ability to transfer weights between front, back and proximal sides independently or in coordination with each other on a vehicle may be critically important to multi-terrain vehicles that often travel along sloped or uneven surfaces and are subject to imbalance between its proximal sides. Said device and system may be scaled down in size for the ability to finely adjust counterweight load or alternatively scaled up in size to cross fit smaller vehicles to meet heavier work demands. The device and system of this invention is versatile and adaptable to a diverse variety of machinery designs. The ability to specially tailor configuration of a system specific to a desired functionality for a machine is incredibly valuable in the industry, allowing users to maximize cross over functionality of their existing equipment.

A. Elements of Invention

The present invention provides a configurable and variable counterweight system for a material handling machine (that is either stationary or movable in design) comprising one or more planar paths, said planar paths containing any one or combinations of straight, curved or angled portions between at least a first and second end, said planar path having transferable counterweights, said planar path or counterweights communicating (remotely or otherwise) with a control device and system, said control device and system comprising one or more drive unit and optionally one or more sensors, said counterweights being able to move along any curved, angled or straight portions of said planar path. Said drive unit comprising an energy source (i.e. any known energy source such as but not limited to electric, pneumatic, hydraulic, manual power, etc.) and a drive element (i.e. any known drive source such as but not limited to manual lever, rotary axle drive, pressure accumulator, motor pump, etc.). Said counterweights transferred along said planar path by way of a transfer element (i.e. any known transfer element that holds and move counterweight in linear fashion such as but not limited to chain, belt, pipe, tube, rails, valve-chambered system, etc.). Said planar path and transfer element may be one in the same or as separate elements. Counterweight movement may be controlled (adjusted and distributed) by automatic or manual means. Automatic control means further comprising communication (remotely or otherwise) between one or more sensor elements, said counterweight device and optionally said material handling machine, or any combinations thereof.

"Material handling" is construed to include not only movement of material within a component of the machine, but also material outside the machine, e.g. dirt which is scooped into the bucket, or material drilled or broken or otherwise transformed by the vehicle. A material handling machine comprising any type of industrial machine, whether or not having attached mobilizers such as wheels or is stationary by design, for purposes of handling material as defined above. A material handling vehicle being more specifically a material handling machine having a mobilizing feature such as wheels or tracks.

B. Counterweight Matter

The counterweight matter of this invention may be solid, semi-solid or fluid (i.e. liquid, pliable or flowable solid matter) but essentially may be moved along one or more substantially planar paths, in dividable units, said counterweight units transferable over straight, curved or angled portions or surfaces along said planar path without substantially obstructing its own movement to enable compaction or consolidation of said weights in organized fashion, such as rolling or folding of solid weights, etc. Flowable, pliable or liquid weights may be more easily transferred through tube or pipe system, contained or compacted within valve-chambers. Said valve-chambered pipe system functioning as both planar path of movement and transfer element and may take on straight, curved or angled shapes. The additional ease of moving fluid matter in free floating manner allows counterweights of this invention to travel through multiple planar paths concurrently by at least a single drive and control mechanism.

The counterweight may be embodied as a plurality of individual solid masses directly attachable to a transfer element or alternatively held within a chamber, said chamber either separately connected to the transfer element or otherwise integrated within said element. This is a practical option when working with softer or brittle matter (i.e. lead) that may break off by its own weight. The counterweights in fluid form may comprise actual liquid (i.e. ferrofluid or Calcium Chloride) or small flowable or pliable solid matter such as beads submersed in viscous material. The advantage of a fluid system allows the transfer of weights to move concurrently in multiple directions with single drive unit.

C. Transfer Element

According to one embodiment of the invention herein, a plurality of individual counterweights in solid form, each individually positioned adjacent to another, held and moved along said planar path, whose position individually or as a group are adjustable (movable) by a transfer element to any choice location between the front and rear portions of the material handling machine. Said transfer element of this embodiment is preferably a rotary axle drive by hydraulic power source but may be from any known type of drive device and power source (i.e. electric, pneumatic, manual, or any other known type of power source), method or system that allows said plurality of adjacently positioned counterweights to move in tandem forwards and backwards along the primarily planar path. Said transfer element is preferably a length of chain, wire or belt attached to, sleeved through or containing a plurality of individual counterweights. Alternatively, the element may be links interconnected between counterweight masses that are pivotal at the points of connection.

Said transfer element pulling said counterweights along a given direction as the transfer element winds or unwinds by rotary axle and drive element. Alternatively, a transfer element comprised of rope or wire may be loosely sleeved through each individual counterweights of the plurality of counterweights and permanently affixed to the first and last weight on the chain. Said rope wire may wind or unwind by rotary axle and drive to move the rope wire and weights held thereon in a forward or backward direction. The attached first or last weight being stationary in nature would naturally pull the loosely sleeved counterweights in between along the track like a caboose and carriages on a train.

Each individual counterweight of the plurality of counterweight is preferably positioned freely in adjacent manner. Freedom of movement between adjacent individual counterweights is necessary to allow pivotal movement over curved or angled portions of the planar path without obstruction of counterweights against each other's movements. Such freedom of movement further allows the counterweights to wrap over each other at either rotary axle ends. Wrapping of weights may be in a consolidated roll or in a zig-zag folded orientation.

The transfer element with attached counterweights of this solid form counterweight device and system is preferably driven and retained at one or more ends by one or more rotary axles. For maximum concentration of counterweight load, the entirety of counterweights on a given device may be consolidated at the location of the rotary axle. As such, location of the rotary axle will be a strategic consideration when attaching said device to any given material handling machine. The transfer element may alternatively be held and guided within a grooved track or rail that helps to guide direction of movement, particularly when involving loosely configured counterweights. The transfer element need not be limited in its manner of holding said plurality of individual counterweights as long as it is able to transfer a defined number and amount of individual counterweights in adjacent position (and possibly in multiple layers) along a planar axis path. Therefore, said transfer element may comprise any of the following means, but not necessarily limited to such: a length of belt having adjacent pockets containing individual weights of specific size or volume, a wire loosely sleeved through a plurality of individual weights, a chain pivotally attached to individual counterweights by hook or wire connection, interconnected pivotal links, a valve-chamber system wherein material is transferred by directed pressure. According to above described embodiments, the plurality of counterweights may be moved along one or more planar paths through multiple angles, sides and directions.

D. Weight Per Surface Area

Total amount of weight per surface area unit may further be maximized by this invention by layering method. At a minimum, a first layer of adjacently positioned individual counterweights as described above is provided. A secondary lateral layer(s) of individual counterweights may be attached onto said first or prior layer of counterweights to increase counterweight load per surface area unit. The individual counterweights of the secondary lateral layer(s) should also be positioned in adjacent free manner to minimize interference of movement over curved or angled surfaces. The freedom to pivot and move over uneven surfaces also provide ability to roll together in multiple layers over a rotary axle end or in a folded pattern. Additional secondary lateral layers may be attached in similar manner to increase and maximize total counterweight load per available surface area on a machine. Counterweights may be spaced apart at variable distances on said transfer element to facilitate unique manner of locating and varying the weights on a machine of a given shape and design. Spacing between weights may also allow multiple layers to roll together more effectively. For example, greater space in between individual counterweights in the upper layers will minimize obstruction of weights within and between the layers when they are cumulatively rolled together.

E. Drive Device & Energy Source

The energy source of the drive unit is preferably hydraulic, electric, pneumatic or manual. The drive unit further comprising a drive element which may be by a rotor axle means having a sprocket for driving the transfer element or a cog for driving a belt, either of which mounted on a rotary axle. As described above, the drive unit may alternatively comprise a pressure accumulator using compressed air or gas, valved chamber system wherein vacuum pressure creates directed force similar to a human heart valve system.

F. Control Unit & Sensors

A control unit may further communicate with the device to direct movement of the contained weights. Said control unit may comprise of electrical, digital, or manual method of controlling power and direction of movement. In the case of a digital means of control, electrical sensors may be set to read the position of the boom and the position of counterweight. Sensors may further comprise a combination of digital, electrical, magnetic means or any other known means that allow for either wired or remote ability to accurately sense and calculate location and load of weight in a meaningful real time manner. The sensors further react to digital control means by moving either the boom or counterweight towards a designated location and direction according to parameters designated at the control unit. Designation of movement at the control unit may be by live operator choice or by predetermined automatic means. Said sensors comprising but not limited to a vertical sensor, a horizontal sensor and a tilt sensor to assess the coordinated and changing load position of the machine and its shifting center of gravity. For example, said control unit receives input from the vertical sensor of real time location of load and center of gravity to which an output designation is provided by the operator for a responding reaction and variable adjustment of counterweight or reinforcement weight. In the case of lifting movement where the boom is in an elevated position, the control unit powers and directs the drive unit to move the counterweight to a designated location to the rear of the vehicle according to an algorithm that coordinates counterweight. In the case of downward pushing movement, for example a drill or jackhammer, the counterweight is directed to the front of the vehicle according to algorithmic calculations that coordinate reinforcement weight. Distribution of counterweight may also be manually adjusted by an operator, particularly useful as an emergency safety system in case of system failure.

These and additional object, advantages, features and benefits of the present invention will become apparent from the following specification.

BRIEF DESCRIPTION OF THE DRAWINGS

The present invention is illustrated by way of example, and not by way of limitation, in the figures of the accompanying drawings and in which like reference numerals refer to similar elements. Unless otherwise indicated illustrations in the figures are not necessarily drawn to scale.

DETAILED DESCRIPTION OF THE PREFERRED EMBODIMENT

Reference will now be made in detail to exemplary aspects of the present invention which are illustrated in the accompanying drawings. Wherever possible, the same reference numbers will be used throughout the drawings to refer to the same or like parts.

Figure 1:
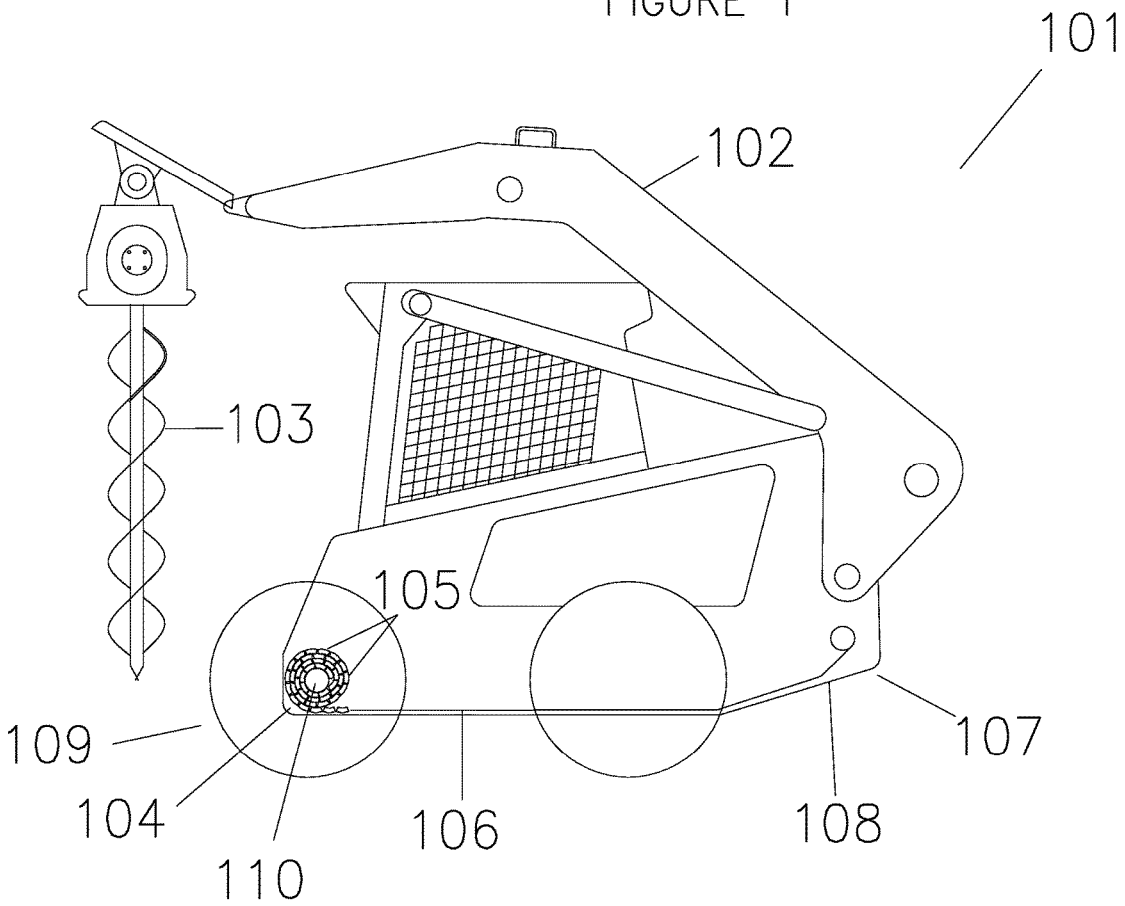
FIG. 1 is a left side plan view of an exemplary embodiment of the invention herein.
Figure 2:
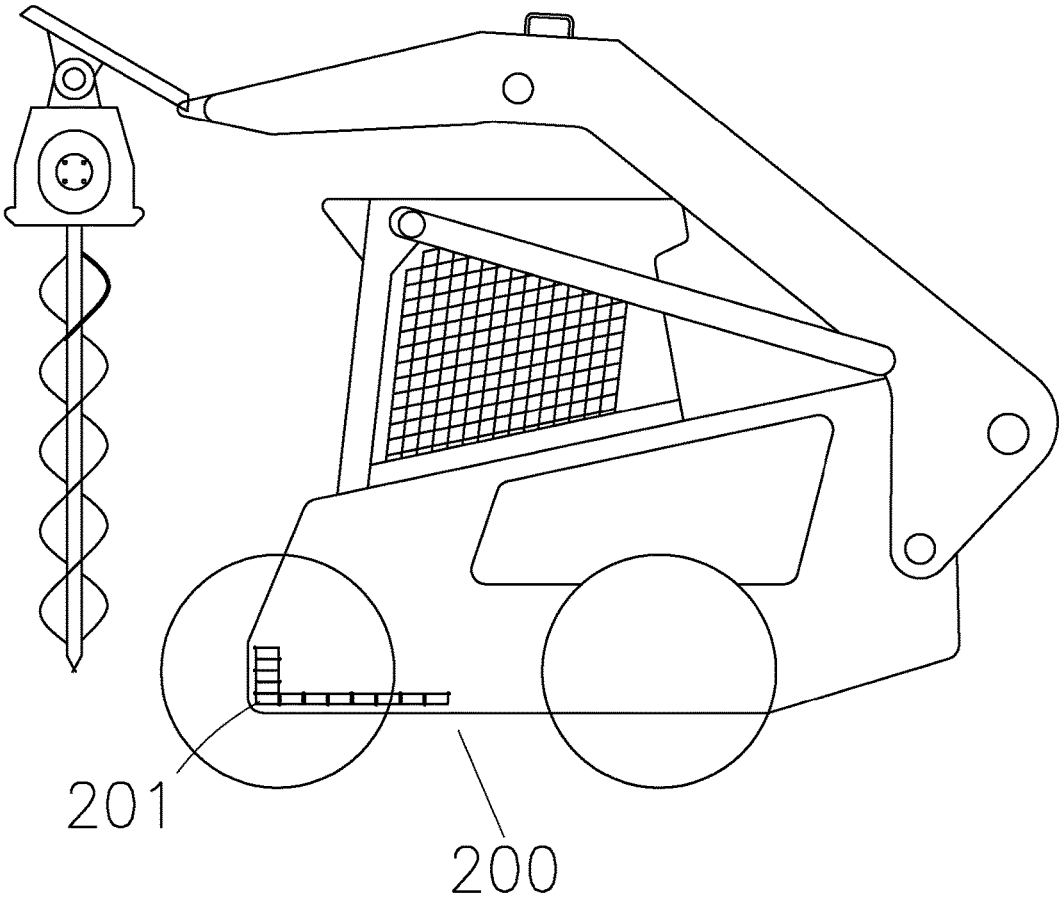
FIG. 2 is a left side plan view of an alternative embodiment of the invention herein.
Figure 3:
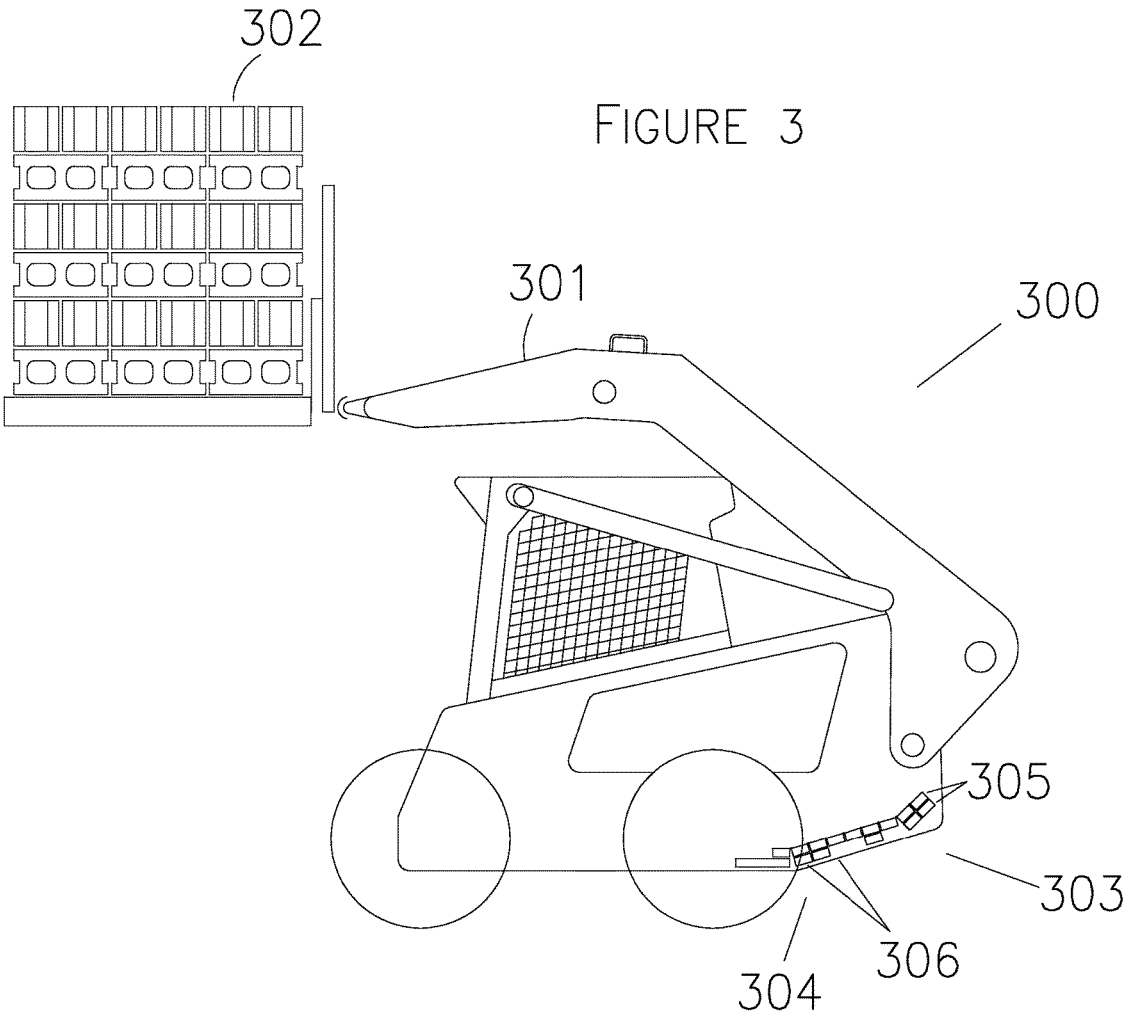
FIG. 3 is a left side plan view of an alternative embodiment of the invention herein.

Referring to FIG. 1, a vehicle type material handling machine 101 having a work arm (boom) 102 carrying a drill frontward 103. A counterweight device 104 of this invention, containing a plurality of individual solid form counterweights 105 along a linear planar path 106 attached to the bottom 107 of the vehicle. In this case, the counterweight device 104 is held within the chassis 108 of the vehicle, protected from external debris. It is further possible to achieve an even lower center of gravity on hydrostatic vehicles that do not rely on a chassis configuration. In such case, the linear planar device 104 may be attached at lower level external to vehicle's bottom surface 107 with still sufficient clearance to avoid interference with the ground surface. According to the example of FIG. 1, the counterweight 105 is consolidated towards the front 109 of the vehicle in a rolled position within a rotary axle 110 to provide the greatest amount of reinforcement leverage to the drilling machine 103. FIG. 2 illustrates the same invention 200 with an alternative zig-zag 201 manner of counterweight consolidation. FIG. 3 illustrates a similar material handling machine 300 with a work arm (boom) 301 that, in contrasts to FIG. 1, lifts heavy material load 302. As such, counterweight is preferably consolidated towards the rear 303 for maximal counterweight leverage.

Figure 4A:
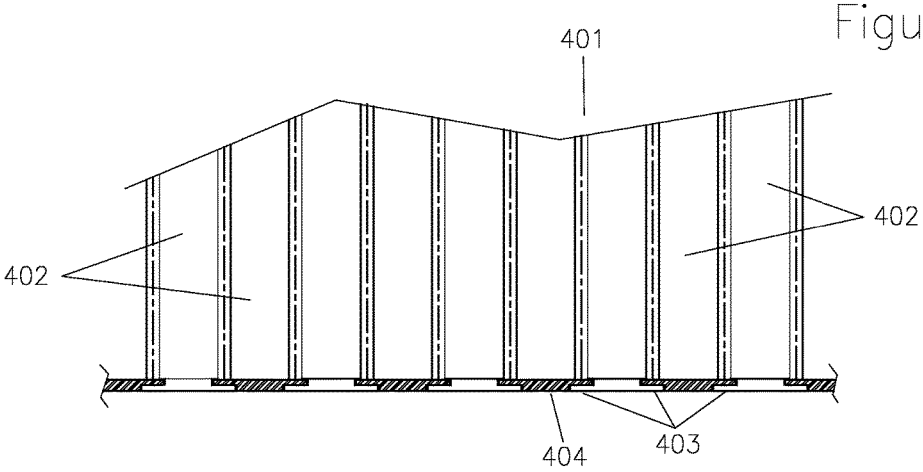
FIG. 4*a* is a top plan sectional view of a preferred embodiment of the invention herein.
Figure 4B:
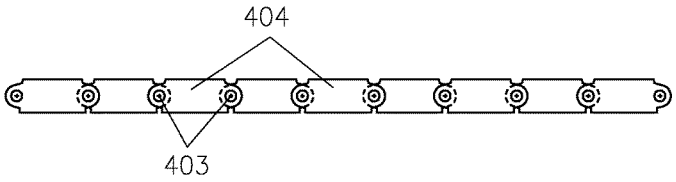
FIG. 4*b* is a side plan sectional view of a preferred embodiment of the invention herein.
Figure 5:
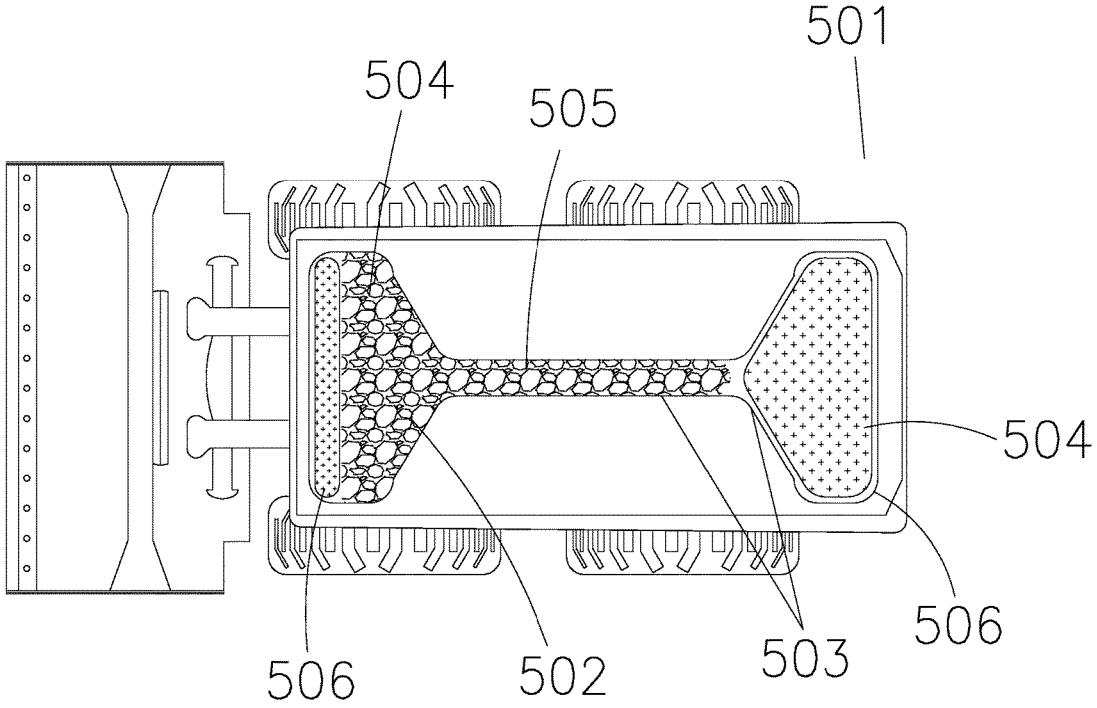
FIG. 5 is a top plan view of an alternative embodiment of the invention herein.

FIGS. 3, 4*a*, 4*b*, and 5 provide examples of potential embodiments of counterweight mass and transfer element configurations. The embodiment of FIG. 3 illustrates a multilayered counterweight stacking option 304 having two or more layers 305 of counterweights attached vertically 305 and adjacently 306. FIG. 4*a* illustrates a linear embodiment of the invention 401 wherein lengths of solid weights 402 are attached (in this case linked) 404 to a linear transfer element and are moved forward and rearward by a drive system (not shown). FIG. 4*b* illustrates the same method of link interconnection 404 between the weights 402 that eliminates the need for rope chord and enables the zig-zag consolidation pattern shown in FIG. 2. FIG. 5 provides an alternative transfer element and counterweight system 501 within the scope of this invention wherein liquid, fluid counterweight 502 (i.e. flowable or pliable matter as defined above within this disclosure) is held within a transfer element 503 (a pipe and chamber) and transferred between chambers 504 through a length of space (i.e. tube) 505 by pressurized force (a bladder system 506). The pressurized force, according to this exemplary embodiment is generated from the interaction between two or more vacuum or pressure chambers 506 controlled by release valves or diaphragm which direct flow of material to and from the enclosed chambers 506. The system mimicking self directing movement of blood through an mammalian heart valve.

Figure 6:
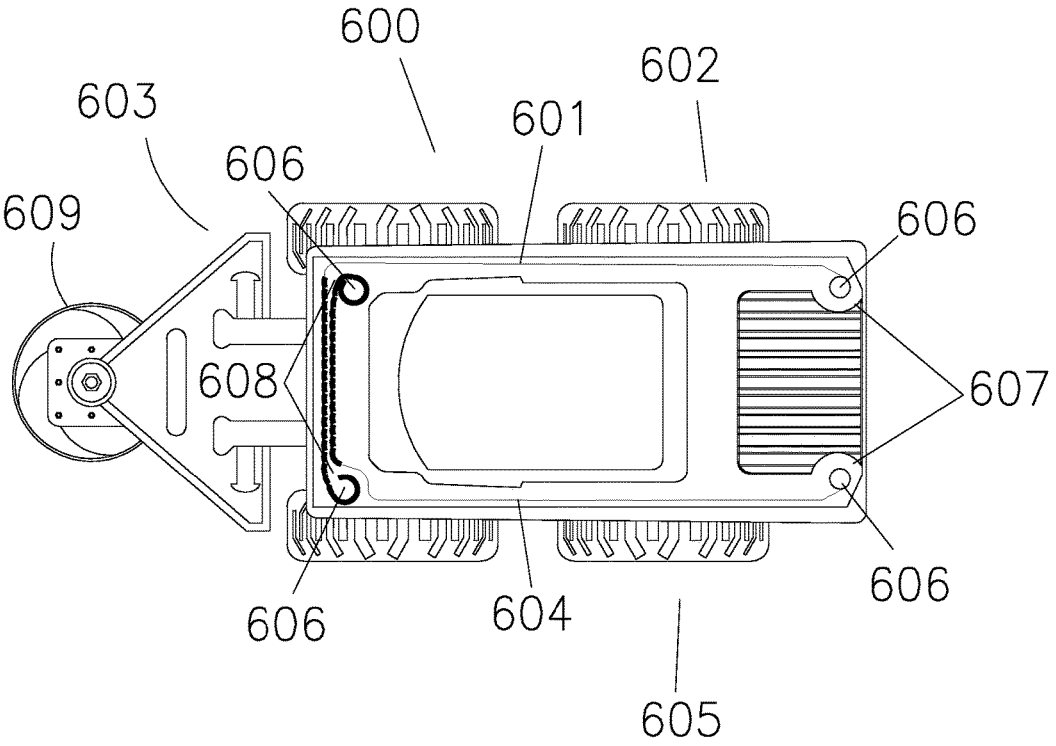
FIG. 6 is a top plan view of an alternative embodiment of the invention herein.
Figure 7:
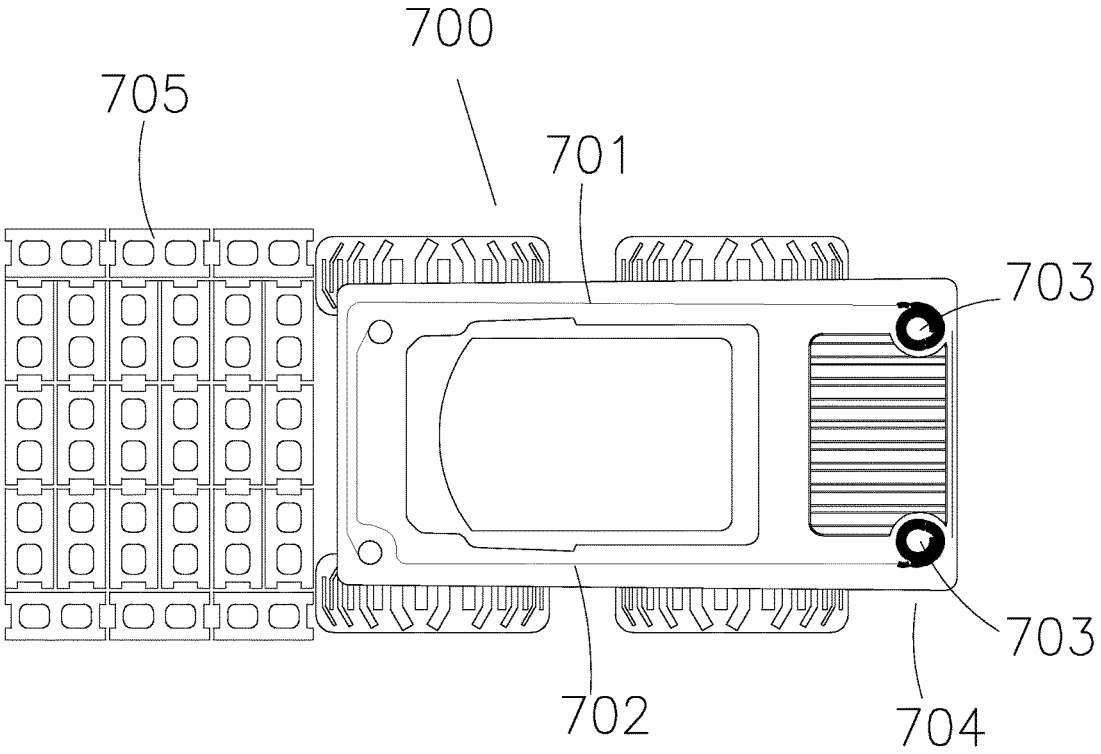
FIG. 7 is a top plan view of an alternative embodiment of the invention herein.
Figure 8:
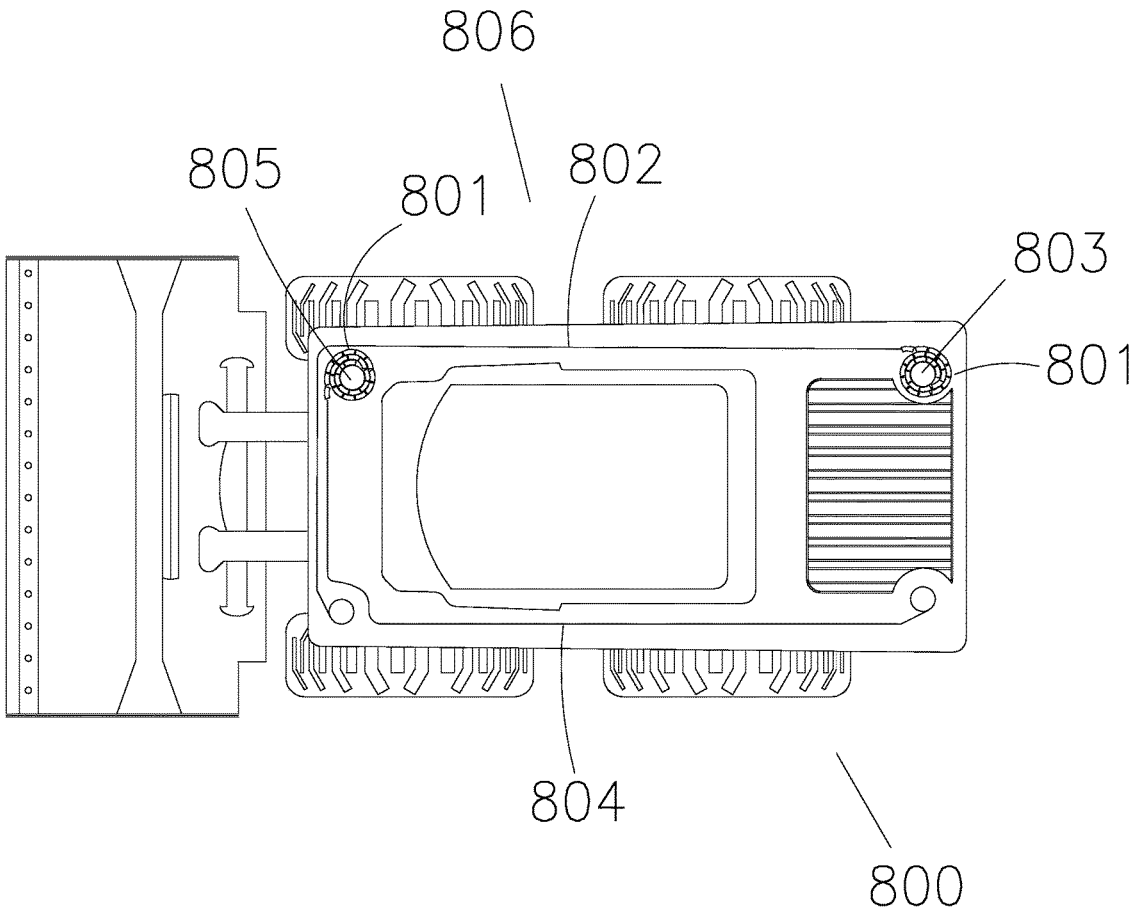
FIG. 8 is a top plan view of an alternative embodiment of the invention herein.

FIGS. 6, 7 and 8 further illustrates different strategic orientations of one or more transfer elements on a material handling machine 600 to maximize counterweighing effect. FIG. 6 provides two devices wherein a first transfer element 601 is positioned along the length of the right side 602 of the vehicle and wraps towards the front side 603 of the vehicle 600. Conversely, a second transfer element 604 is positioned on the left side 605 of the vehicle 600 and wraps towards the front side 603 of the vehicle 600. Both devices 601, 604 being driven by rotary axles 606 located at a first 607 and second end 608 of the transfer elements. In this embodiment, the weights are consolidated towards the front side 603 of the vehicle 600 and distributed evenly across for maximum even reinforcement weight with use of a drill 609.

Figure 9:
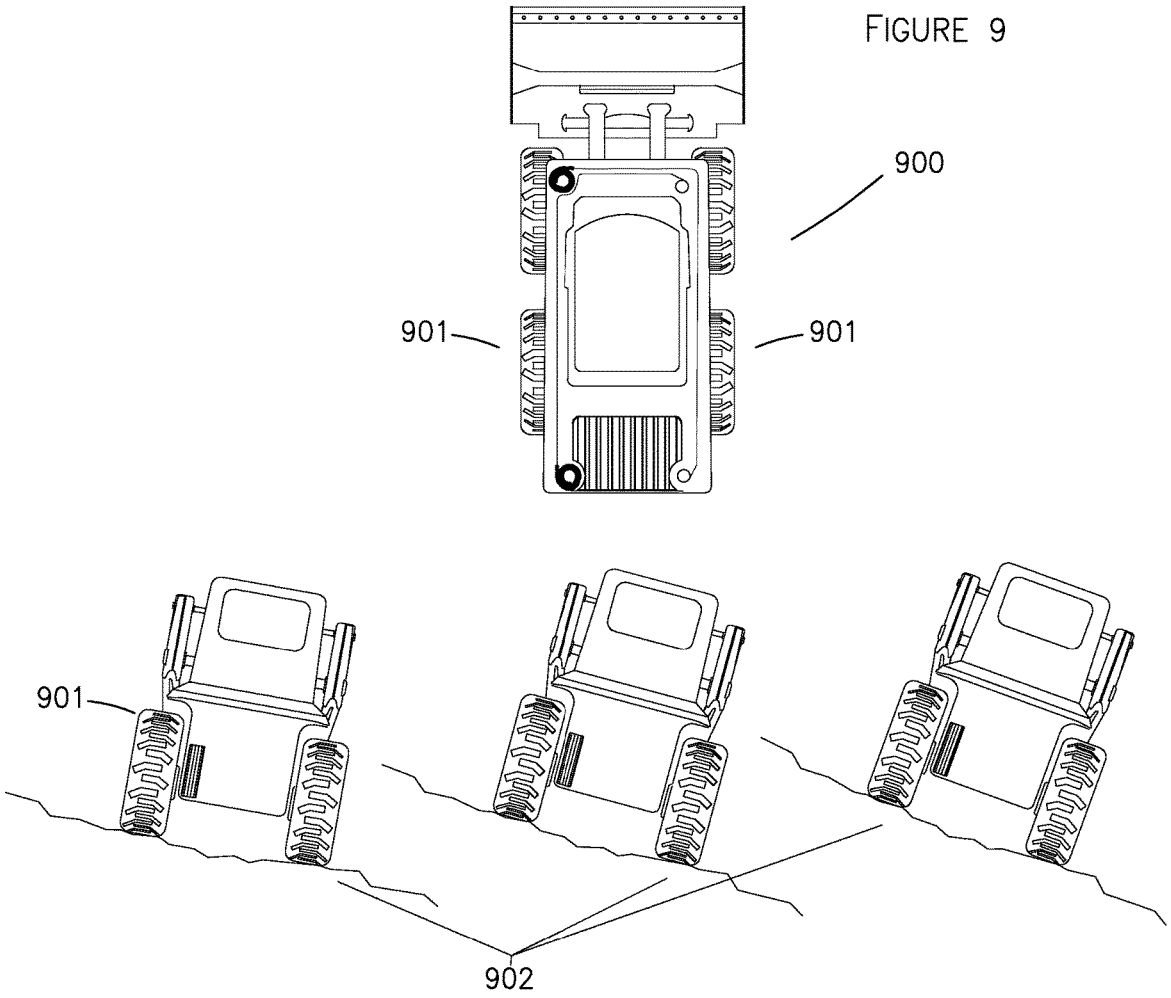
FIG. 9 comprising top and rear plan views of an alternative embodiment of the invention herein.

FIG. 7 provides a similar configuration of two transfer elements 701, 702 wherein counterweights 703 are consolidated towards the rear 704 of the material handling machine 700 to achieve maximum and even counterweight leverage for a lifting arm 705. FIG. 8 provides a third manner of consolidating counterweights for the same configuration of FIGS. 6 and 7 wherein counterweights 801 of a first transfer element 802 is consolidated completely at its rear rotary axle 803 and counterweights 801 of a second transfer element 804 is consolidated completely at its front rotary axle 805. This results in maximum counterweight leverage towards the right side 806 of the machine 800. FIG. 9 illustrates the benefits of counterweighing a proximal side 901 of a vehicle machine 900 according to FIG. 8, particularly when heavy loaded vehicles 900 travel through uneven sloped terrain 902.

Figure 10:
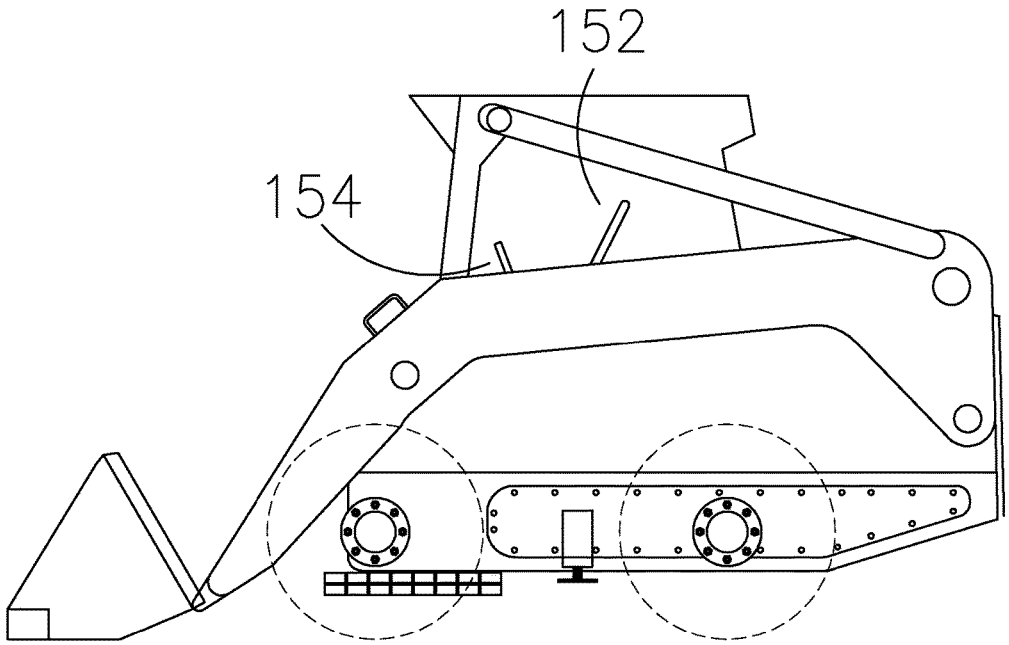
FIG. 10 is a left side plan view of an exemplary embodiment of the invention herein.

According to FIG. 10, the control unit 154 is preferably positioned near the operator 152 for the option of user control. Vertical sensors (not shown) attached to the work arm and alternatively to the counterweight load of this invention may determine the load differential of the machine at any given time and position. The control unit may further be sensitive to the tilt and central gravity position of the machine, using a tilt meter or a gravitometer sensor. Said control unit receives input from said sensors either remotely (i.e. via electro-magnetic means) or by wired means. Should the work arm (either bucket or boom) be in elevated position or lowered position, the control unit may automatically react according to preset algorithmic parameters to adjust and distribute counterweight to a desired location for the desired effect.

It is to be understood that any exact measurements/dimensions or particular construction material indicated herein is solely provided as examples of suitable configurations and is not intended to be limiting in any way. Depending on the needs of the particular application, those skilled in the art will readily recognize, in light of the following teachings, a multiplicity of suitable alternative implementation details.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

We claim the following:

1. A configurable and variable counterweight system for a material handling machine comprising one or more configurable counterweight devices each said configurable counterweight device of said one or more configurable counterweight devices comprising a plurality of individual counterweight units connectable to a non-rigid transfer element, said non-rigid transfer element comprising a planar path having a first end and a second end whereby each individual counterweight unit of said plurality of individual counterweight units is transferable on said non-rigid transfer element in a forward or aft direction between its said first or second end, said planar path of said non-rigid transfer element comprising any two or combinations thereof of straight, curved, angled or rollable portions, said non-rigid transfer element connectable to an energy source, drive element, and control unit for transferring said plurality of individual counterweight units thereon, whereby said plurality of individual counterweight units are transferable along adjacent surfaces or adjacent sides of said material handling machine.

2. Said configurable and variable counterweight system for a material handling machine according to claim 1 wherein said plurality of individual counterweight units comprising counterweight mass in solid, flowable or pliable form.

3. Said configurable and variable counterweight system for a material handling machine according to claim 1 wherein each said counterweight unit of said plurality of counterweight units are transferable along said planar path according to predetermined size or weight to a designated location along said planar path.

4. Said configurable and variable counterweight system for a material handling machine according to claim 1 wherein said transfer element is connected to an energy source, drive element, control unit and one or more sensors, each said sensor of said one or more sensors comprising any one or combination of a vertical, horizontal, or tilt sensor for assessing the coordination, changing load position or center of gravity of said material handling machine.

5. Said configurable and variable counterweight system for a material handling machine according to claim 1 wherein said plurality of individual counterweight units are automatically, manually or remotely transferable.

6. Said configurable and variable counterweight system for a material handling machine according to claim 1 wherein each individual counterweight unit of said plurality of individual counterweight units is connectable to said transfer element adjacently to another individual counterweight unit in side by side manner or above and below another individual counterweight unit in layered manner or by combinations thereof.

7. Said configurable and variable counterweight system for a material handling machine according to claim 1 wherein said plurality of individual counterweight units is transferable along said transfer element by said control unit wherein said control unit is automatically, remotely or manually controllable by digital, electric, or magnetic means or combinations thereof.

8. Said configurable and variable counterweight system for a material handling machine according to claim 1 wherein said configurable counterweight devices is attachable along the chassis side and an adjacent side of said material handling machine with sufficient spatial clearance between said material handling machine and the ground surface thereunder.

9. Said configurable and variable counterweight system for a material handling machine according to claim 1 wherein one or more said configurable counterweight devices is attachable to a material handling machine.

10. Said configurable and variable counterweight system for a material handling machine according to claim 1 wherein said planar path of said transfer element comprising a rollable or stackable portion.

11. Said configurable and variable counterweight system for a material handling machine according to claim 1 wherein said plurality of individual counterweight units are linearly transferable in preconfigured form by non-rigid conveyor means or by pressurized chamber means.

12. Said configurable and variable counterweight system for a material handling machine according to claim 1 wherein said non-rigid transfer element comprising rope, wire, belt, chain components or combinations thereof.

13. Said configurable and variable counterweight system for a material handling machine according to claim 1 wherein said non-rigid transfer element comprising one or more pressurized valve chamber or bladder component.

14. Said configurable and variable counterweight system for a material handling machine according to claim 1 wherein said plurality of individual counterweight units is able to be consolidated in bulk manner by rolling or stacking.

15. Said configurable and variable counterweight system for a material handling machine according to claim 1 wherein each said configurable counterweight device of said one or more configurable counterweight devices is attachable to two or more adjacent sides or surfaces of said material handling machine.

* * * * *